US008106319B2

(12) United States Patent
Yeomans et al.

(10) Patent No.: US 8,106,319 B2
(45) Date of Patent: Jan. 31, 2012

(54) DOUBLE BEAM SWITCH CONTACT

(75) Inventors: Michael Anthony Yeomans, Camp Hill, PA (US); Ricardo L. Koller, Lititz, PA (US)

(73) Assignee: Tyco Electronics Corporation, Middletown, PA (US)

( * ) Notice: Subject to any disclaimer, the term of this patent is extended or adjusted under 35 U.S.C. 154(b) by 1029 days.

(21) Appl. No.: 11/687,054

(22) Filed: Mar. 16, 2007

(65) Prior Publication Data

US 2008/0226014 A1 Sep. 18, 2008

(51) Int. Cl.
*H01H 1/40* (2006.01)
*H01R 13/70* (2006.01)

(52) U.S. Cl. ..... 200/61.19; 200/16 A; 200/16 D; 200/51.11; 200/506

(58) Field of Classification Search ..... 200/1 B, 200/1 R, 5 C, 16 R–16 D, 42.01, 43.01, 43.02, 200/51 R, 51.11, 52 R, 61.19, 506, 283
See application file for complete search history.

(56) References Cited

U.S. PATENT DOCUMENTS 3,701,862 A * 10/1972 Vignini ..... 429/97
4,095,074 A * 6/1978 Lockard ..... 200/295
4,421,959 A * 12/1983 Chen et al. ..... 200/16 A
5,034,724 A * 7/1991 Tone ..... 340/571
5,053,750 A * 10/1991 Alex ..... 340/568.7
5,057,824 A * 10/1991 Stokes ..... 455/127.1
5,587,568 A * 12/1996 Lothamer et al. ..... 200/16 R
5,811,744 A * 9/1998 Bartha ..... 200/5 A
6,091,037 A * 7/2000 Bachschmid ..... 200/551
6,156,981 A * 12/2000 Ward et al. ..... 200/16 D
6,198,058 B1 * 3/2001 Graninger et al. ..... 200/50.02
6,351,207 B1 * 2/2002 Mik et al. ..... 340/573.1
6,576,853 B2 * 6/2003 Motojima ..... 200/51.09
6,753,486 B2 * 6/2004 Matsui ..... 200/61.41
7,030,325 B2 * 4/2006 Blossfeld et al. ..... 200/11 R
2010/0049216 A1 * 2/2010 Zergiebel ..... 606/143
2010/0271815 A1 * 10/2010 Gomez ..... 362/184

* cited by examiner

*Primary Examiner* — Michael Friedhofer

(57) ABSTRACT

An LCD counter assembly including a housing that houses an LCD display at a first end and a printed circuit board (PCB) assembly at a second end opposite the first end. A diffuser is intermediate the PCB assembly and the LCD display, the LCD display and the PCB assembly in electrical contact with a connector that provides electrical signals from the PCB assembly to the LCD. The first end of the housing includes an aperture through which the LCD display is readily visible to an observer. The PCB assembly may include a backlight to improve the visibility of the LCD display. The PCB assembly further includes a PCB having a printed circuit and a plurality of pads, a single piece, double beam, activation and trigger switch combination assembled to the board, the board configured to receive the double beam activation and trigger switch combination and a removable tab to separate the activation switch in the double beam combination from one of the plurality of pads.

3 Claims, 5 Drawing Sheets

DOUBLE BEAM SWITCH CONTACT

FIELD OF THE INVENTION

The present invention is directed to a switch contact and specifically to a single piece switch contact that includes both device activation and trigger functionality.

BACKGROUND OF THE INVENTION

Miniature current switch contact devices used with portable liquid crystal display (LCD) counters and powered by self-contained power sources, such as batteries that provide direct current currently require three separate stamped components assembled into a molded plastic housing and connected to a hand soldered wire. Such devices require assembly of the three separate components into the housing as well as the hand soldering operation.

A miniature current switch contact device that utilizes a single stamped component would reduce the costs of stamping three parts as well as the costs of assembly of the contact device into the dielectric housing, while improving reliability.

SUMMARY OF THE INVENTION

The present invention comprises an LCD counter assembly that includes a housing that houses an LCD display at a first end and a printed circuit board (PCB) assembly at a second end opposite the first end. A diffuser is intermediate the PCB assembly and the LCD display, the LCD display and the PCB assembly in electrical contact with a connector that provides electrical signals from the PCB assembly to the LCD. The first end of the housing includes an aperture through which the LCD display is readily visible to an observer. The PCB assembly may include a backlight to improve the visibility of the LCD display. The housing is further designed to mate with the PCB assembly so that the LCD display, the diffuser, the electrical connector and PCB assembly can be assembled into the housing and captured by the housing and PCB assembly.

The PCB assembly further includes a PCB having a circuit and a plurality of pads, a single piece, double beam activation and trigger switch combination assembled to the board, the board configured to receive the double beam activation and trigger switch combination and a removable tab to separate the activation switch in the double beam combination from one of the plurality of pads. The trigger switch in the double beam combination is movable from a first position to a second position. It is formed so that its first position, also referred to as the assembled or default position is proximate to a second pad in the plurality of pads, but is physically separated from the pad. The trigger switch is movable from this first position to a second position in contact with the pad in response to application of a mechanical force applied to the trigger switch. Removal of the mechanical force from the trigger switch results in the switch returning to its first position.

The LCD counter assembly additionally requires a power source to function. If the power source is an AC source, the LCD counter assembly may include additional wiring to the AC source. Typically, the use of AC current limits the mobility of the LCD counter assembly. An LCD counter assembly that includes a DC power source such as a battery or battery pack may be used to power the LCD counter. The LCD counter assembly may include wires for attachment to a battery pack, which may be removed from the LCD counter to permit recharging, or the LCD counter assembly can be designed to include a housing that can include a battery compartment for a battery such as well-known disk-type batteries (3V).

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
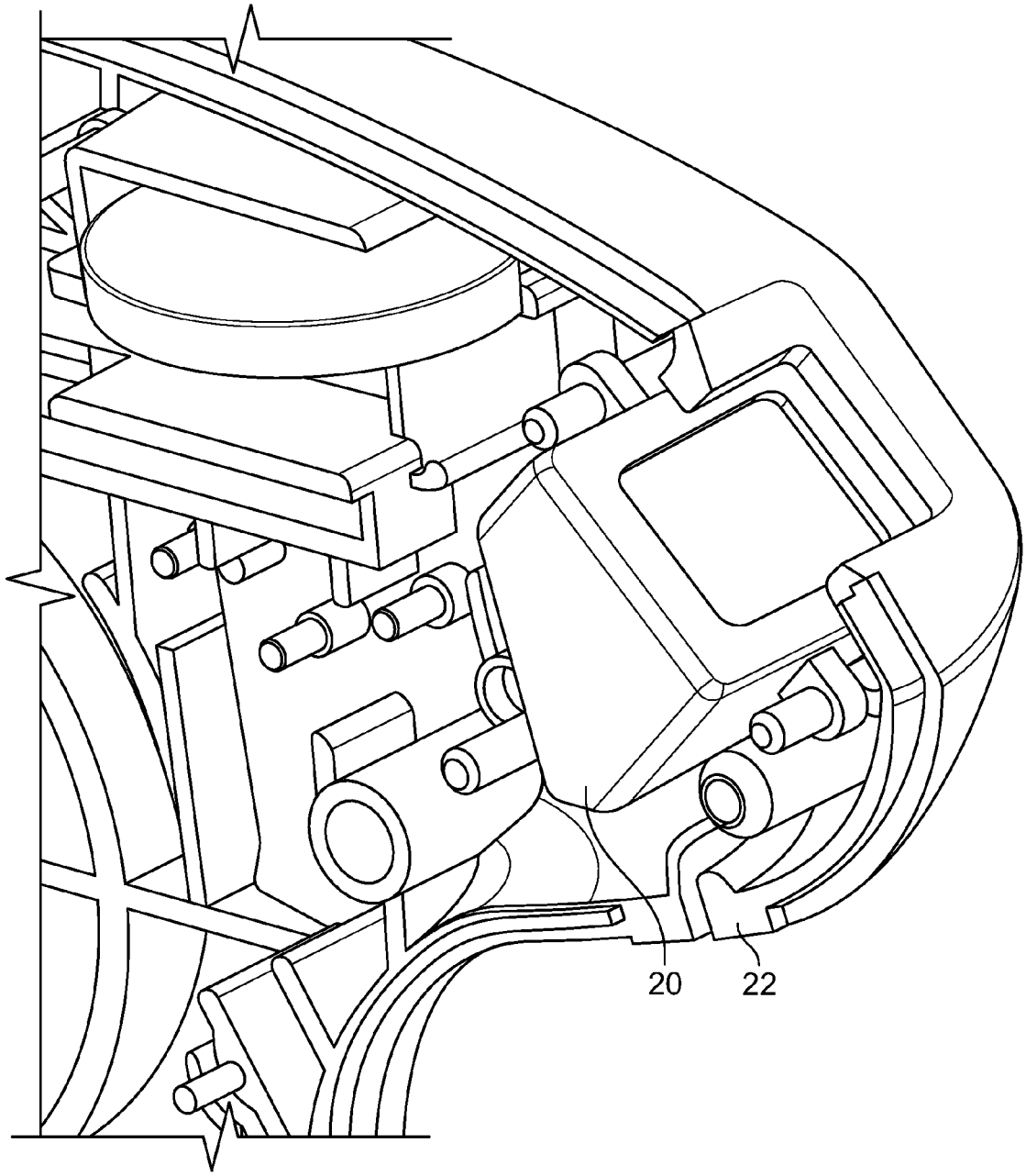
FIG. 1 is a perspective view of an LCD counter installed in an apparatus.

The present invention is an LCD counter device used in conjunction with a tool provided to allow a user to track a plurality of inputs and instantaneously view the number of inputs. The term tool is used broadly to indicate any apparatus that incorporates the LCD counter device to track inputs. FIG. 1 depicts an LCD counter device 20 installed in an apparatus 22. The apparatus 22 can be any device that is utilized to maintain an accurate integral count. The integral count can be an increasing running total. For example, the device can track the number of people or vehicles that pass a point, such as a turnstile or a location on a road. The device can be an integral count that can be a decreasing value of a quantity. Thus, for example, the integral count can be the number of units remaining in the apparatus, the count decreasing as a unit is dispensed from the apparatus. While maintaining an integral count is a function of the LCD counter device 20 of the present invention in an apparatus, the specific use of the apparatus is not critical to the present invention.

Figure 2B:
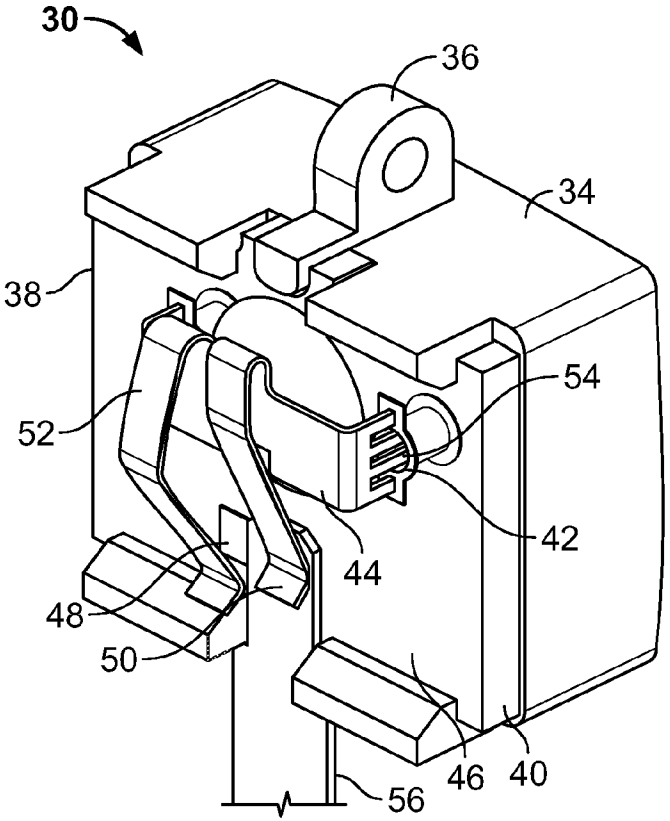
FIGS. 2A-2B depict the LCD counter assembly of the present invention.
Figure 2A:
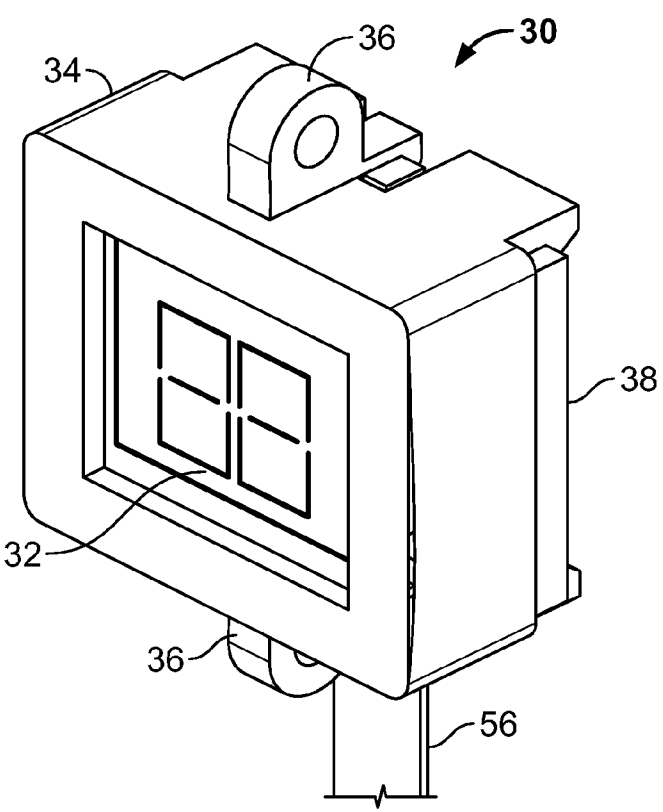

FIG. 2 depicts the LCD counter assembly 30 of the present invention. FIG. 2A depicts a view of the first end of the LCD counter assembly 30 of the present invention, while FIG. 2B depicts a view of the second or opposite end of the LCD counter assembly 30 of the present invention. Referring now to FIG. 2A, a LCD counter display 32 is assembled to housing 34 and is visible through an opening in housing 34. Housing 34 also includes a pair of oppositely disposed mounting lugs 36 for mounting the LCD counter assembly 30 to mating features within the apparatus 22. Assembled to the second or opposite end of the LCD counter assembly 30 is a PCB board assembly 38. Although the board assembly is shown attached to the back of the housing in this embodiment, the housing can be configured so that PCB board assembly 38 is assembled within housing 34.

A rear view of PCB board assembly 38 is depicted in FIG. 2B, which is the side opposite the LCD display. The PCB board assembly includes a PCB board 40 that includes a plurality of apertures 42 and a single piece connector 44 assembled to a first side 46 of PCB board 40. A second side of PCB board 40 not shown in this view, includes the circuitry, connections and traces normally found on a PCB. The specific circuitry design include certain predetermined features unique to each application of an apparatus, 22. However, the PCB board 40 will also include features specific to this invention as will be apparent. The PCB board includes a plurality of pads 48, only one of which is visible in FIG. 2B on the rear side of PCB board 46 that extend through PCB board in electrical communication with the circuitry on the second side of board 40. Single piece connector 44, preferably stamped from sheet metal, includes a double beam contact. The first contact is an activation switch 50, while the second contact is a trigger switch 52. Connector 44 further includes a plurality of arms 54 that are sized for insertion into the plurality of apertures 42 on the PCB board 40. Assembly 38 additionally includes a tab 56 inserted between activation switch 50 and an underlying pad 48 that isolates the activation switch 50 from electrical contact with the pad 48. Since tab 56 isolates the activation switch 50 from electrical contact with pad 48, tab preferably is a dielectric material, such as a non-conductive plastic or even a cardboard. Trigger switch 52 is adjacent to but spaced from, and therefore out of electrical contact with a second pad 48 in the plurality of pads. Trigger switch 52 can be biased into contact with second pad 48 under mechanical force, but will bias out of contact with pad 48 when the mechanical force is removed.

Figure 4B:
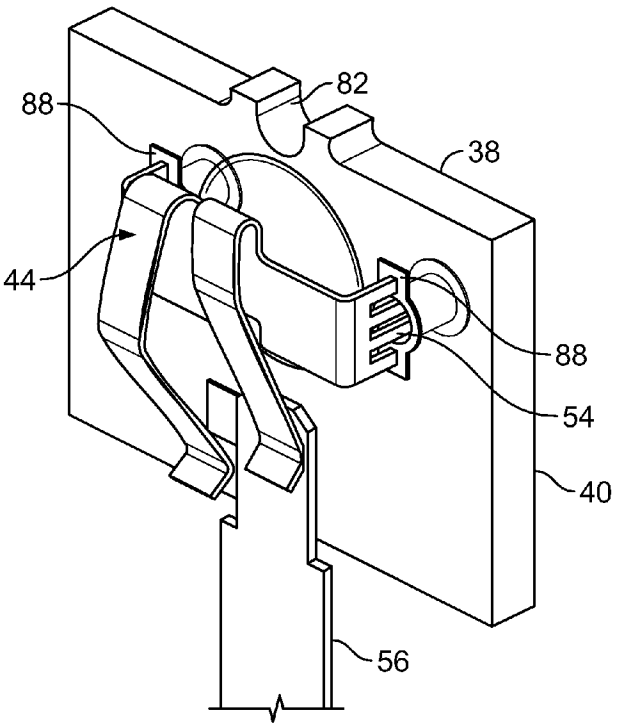
FIGS. 4A-4B are an enlarged view of the PCB board assembly of the present invention.
Figure 4A:
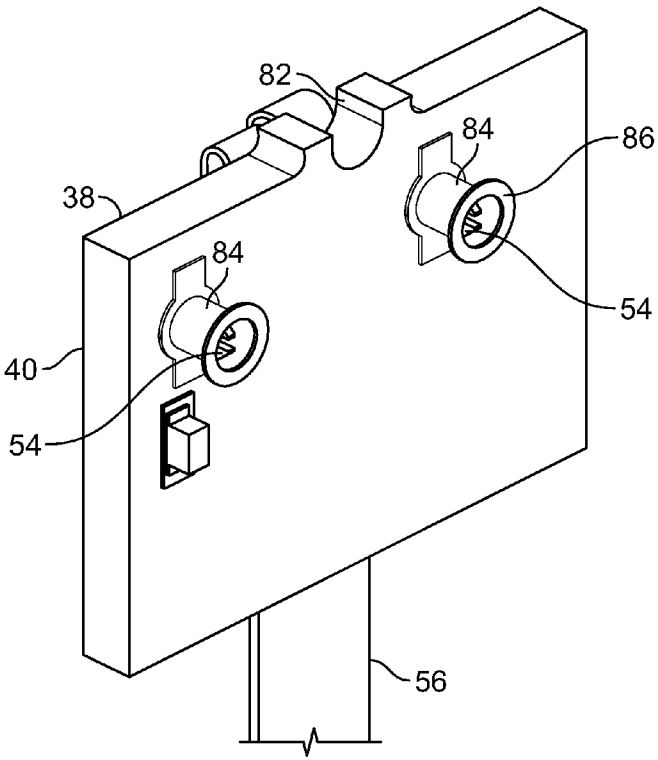

FIG. 4 is an enlarged view of PCB board assembly 38. FIG. 4A depicts a view of the first end of the PCB board assembly 38 of the present invention, while FIG. 4B depicts a view of the second or opposite end of the PCB board assembly 38 of the present invention. In FIG. 4A, a pair of annular metallic beams 84 are evident extending through the board 40, the beams 84 having a flanged surface 86 on the second side having printed face of PCB board 40, the flanged face 86 connected to the printed circuitry as required, and having and a dog-eared surface 88, FIG. 4B, on the first side of board 40. The plurality of arms 54 of the connector 44, each arm having fingers, assembled into the annular beams, preferably by interference fit, are readily soldered into place by automated soldering techniques to establish a firm and reliable electrical connection, preferably metallurgical, between the first side of the board and the second side of the board as the molten solder readily flows into the beam annulus and solidifies in the annulus.

Figure 3A:
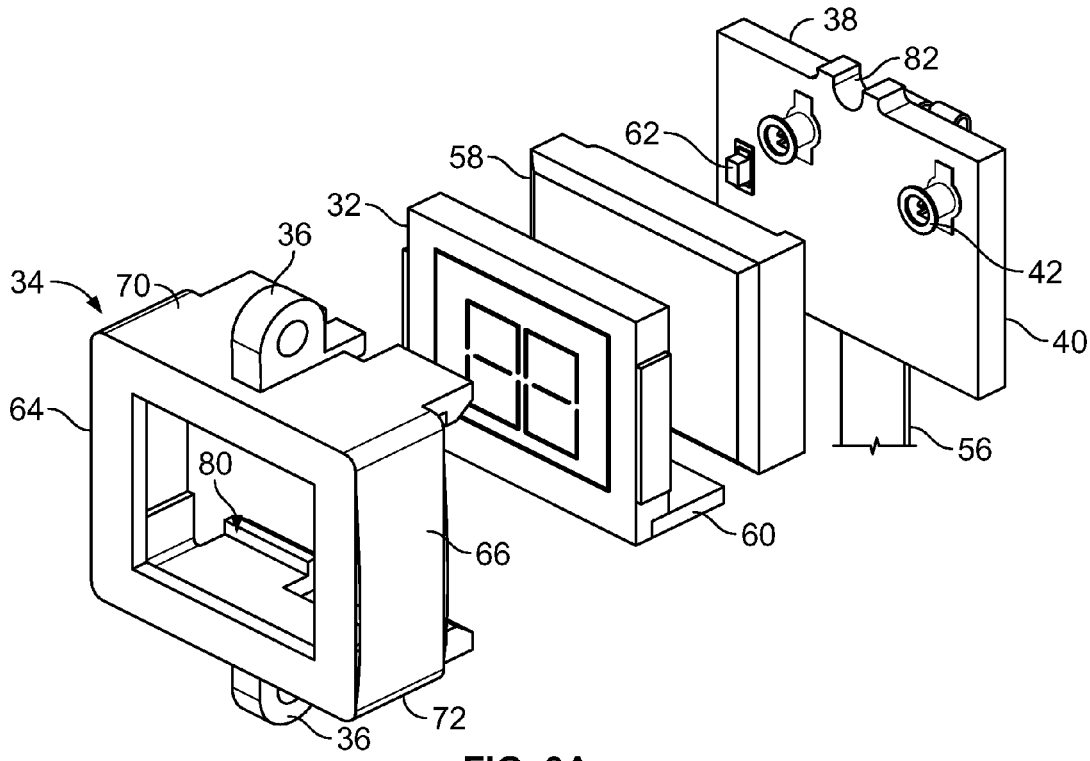
FIGS. 3A-3B are an exploded view of the LCD counter assembly of the present invention.
Figure 3B:
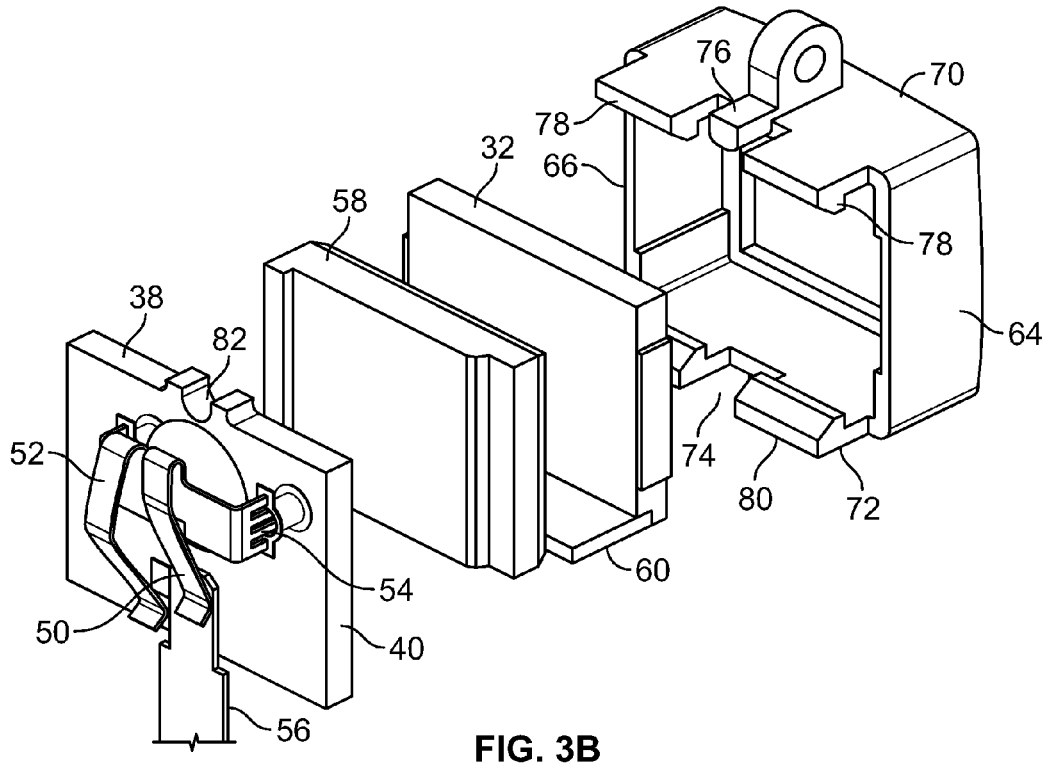

FIG. 3 depicts an exploded view of the LCD counter assembly 30 of the present invention. FIG. 3A depicts a view of the first end of the LCD counter assembly 30 of the present invention, while FIG. 3B depicts a view of the second or opposite end of the LCD counter assembly 30 of the present invention. The counter assembly 30 includes a housing 34, an LCD display 32, a PCB board assembly 38, a diffuser 58 between the PCB board assembly 38 and LCD display 32 and an electrical connector 60 that electrically connects PCB board assembly 38 to LCD display 32. Referring now to FIG. 3A, PCB board assembly 38 additionally includes a backlight 62, so that diffuser 58 can diffuse light from the backlight toward the LCD display 32 to improve the visibility of the numbers on the LCD display, While the backlight 62 may be a light of any color, such as a red light, the preferred light is a blue light. Electrical connector 60 preferably is a Zebra™ elastomeric electronic connector, available from Fujipoly America Corporation of 900 Milik Street, P.O. Box 119, Carteret, N.J. 07008, an elastomeric connector that enables electrical signals to be transmitted from the PCB board assembly 38 to the LCD display 32. FIG. 3B provides a view of the LCD counter assembly 30 of the present invention from its second or opposite end, the features of the PCB board assembly 38, discussed above, being readily discernable.

In the embodiment shown in FIG. 3, the LCD display 32 and diffuser 58 are assembled over Zebra connector 60, all of which are assembled within walls 64, 66, 70, 72 of housing 34. The display is assembled into housing 34 so that the display is visible through the aperture formed by the walls, the walls isolating assembled components from the external environment. If necessary, a thin, transparent protective covering or film can be inserted into the housing 34 prior to insertion of the LCD display 32 to provide protection to the display. Also, if required, rubber seals can be assembled into the housing 34, and assembly of the components into the housing tightly against the seals will substantially secure the interior of the housing from the external atmosphere. While FIG. 3 depicts the LCD display 32 and the diffuser 58 resting on Zebra connector 60 on assembly into housing 34, the invention is not so limited as the function of the Zebra connector 60 is to provide electrical connection between PCB board assembly 38 and LCD display 32. In the embodiment shown in FIG. 3, the LCD display 32 and diffuser 58 are assembled over Zebra connector 60, all of which are assembled within walls 64, 66, 70, 72 of housing 34. The display is assembled into housing 34 so that the display is visible through the aperture formed by the walls, the walls isolating assembled components from the external environment. If necessary, a thin, transparent protective covering or film can be inserted into the housing 34 prior to insertion of the LCD display 32 to provide protection to the display. Also, if required, rubber seals can be assembled into the housing 34, and assembly of the components into the housing tightly against the seals will substantially secure the interior of the housing from the external atmosphere. While FIG. 3 depicts the LCD display 32 and the diffuser 58 resting on Zebra connector 60 on assembly into housing 34, the invention is not so limited as the function of the Zebra connector 60 is to provide electrical connection between PCB board assembly 38 and LCD display 32.

Housing 34 further includes a center aperture 74 on bottom wall 72 having sufficient width to accept tab 56 on assembly of PCB board assembly 38 to housing. Top wall 70 of housing 34 also includes a center latch 76 and a pair of substantially downwardly extending side snaps 78. Bottom wall 72 also includes a pair of side snaps 80, the side snaps 80 extending substantially upward toward side snaps 78. Top wall 70 and bottom wall 72 also have backwardly extending flanges, so that on assembly of the last component, the PCB board assembly 38 to housing 34, the tab 56 is guided into center aperture 74 and the PCB board assembly is captured by the side snaps 78, 80 and locked into position in the housing by center latch 76 which is releasably assembled into notch 82 on PCB board 40. Preferably, tab 56 is formed so that its extension above center aperture 74 is limited so that it contacts PCB board only slightly above the interface between activation switch 50 and corresponding pad 48. This is readily accomplished by providing the latch with different widths, a wider width not capable of extending through aperture 74, while the narrower width which is capable of extending through aperture 74 has a length sufficient to extend between activation switch 50 and corresponding pad 48, preventing contact.

Figure 5:
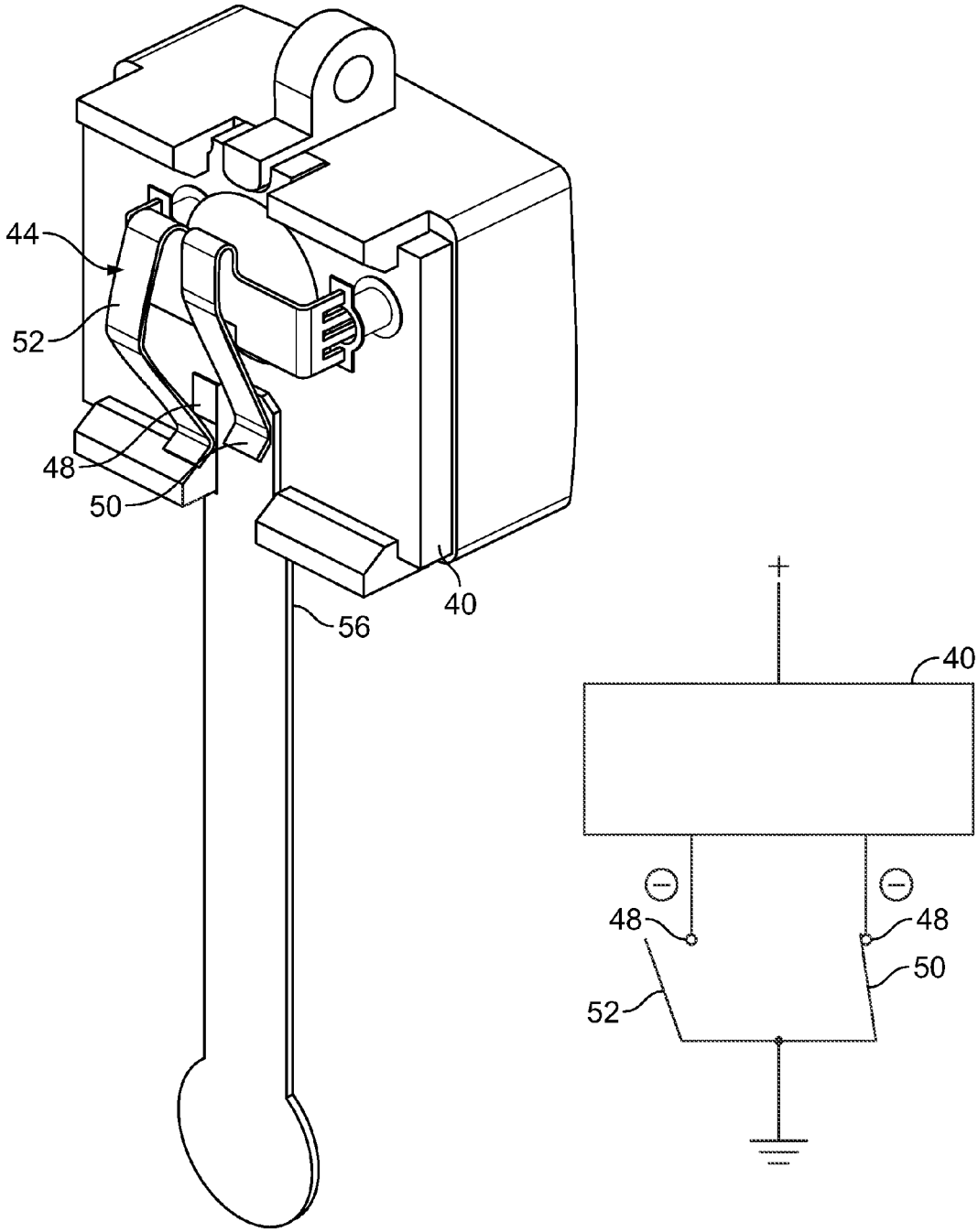
FIG. 5 is a view of the PCB board assembly of the present invention showing operation of the PCB board assembly and the electrical circuitry of the board assembly.

In its simplest operation, reference is now made to FIG. 5, which is a view of the PCB board assembly of the present invention showing operation of the PCB board assembly in FIG. 5A and a schematic of the electrical circuitry of the board assembly in FIG. 5B, the function of the PCB board assembly 38 in conjunction with the LCD counter assembly can be better understood. LCD counter assembly 30, FIG. 2 including a PCB board assembly 38 is assembled into an apparatus 22, such as shown in FIG. 1. A power source, preferably a battery is connected to the PCB board assembly to provide electrical power to the LCD counter assembly. Tab 56, FIG. 5, is removed between activation switch 50 and corresponding pad. The natural bias of activation switch 50 brings it into contact with pad 48, closing the switch combination 48/50 as shown in FIG. 5. Trigger 52 in its normal position is out of contact with a second pad 48 in the plurality of pads. However, when a mechanical force operative in apparatus 22 is brought to bear against trigger switch 52, it brings switch 52 into contact with pad 48, closing the circuit 52 and enabling at least one signal to be transmitted through PCB Board 40 to LCD display, thereby causing LCD display to move incrementally in response to the signal. Another signal is not sent to LCD display unless the mechanical force is removed from trigger switch 52 causing the circuit to reopen and then reapplied. In this manner, the LCD display can be caused to incrementally sequence in response to input from apparatus 22 and an accurate accounting can be provided by reference to the LCD display. Because the PCB board assembly 38 is configured so that both trigger switch 52 and activation switch are wired to one pole of the electrical source, here depicted as negative (although the polarity can be reversed) and the circuitry on the PCB board 40 is wired to the opposite polarity, the connector 44 can be manufactured as one piece, thereby simplifying both assembly of connector 44 to the board 40 as well as the electrical connections with the power source Of course, other features can be added which enhance the basic features described herein, but which otherwise do not alter the operation of the board. For example, the LCD counter assembly can include a reset button, permitting the counter to be reset to zero or a preselected number, if desired. Other features can be designed into the board circuitry as desired.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A single piece, double beam connector comprising a double beam contact, said contact comprising:

a first contact which is an activation switch comprising a first beam;

a second contact which is a trigger switch comprising a second beam, the trigger switch (a) adjacent to the activation switch, and (b) movable from a first position to a second position parallel with the activation switch under an applied force, the trigger switch and the activation switch being stamped from a single piece of conductive metal and connected thereto; and a tab formed of a dielectric material which, when in position, isolates the activation switch from electrical contact with a conductive pad when in position, and when removed, allows the activation switch contact with the conductive pad.

2. The single piece, double beam connector of claim 1 further including a pair of arms substantially at right angles to the activation switch and trigger switch.

3. The single piece, double beam connector of claim 2 wherein each arm of the pair of arms includes at least one finger.

* * * * *